US007075027B1

(12) United States Patent
Fogle et al.

(10) Patent No.: US 7,075,027 B1
(45) Date of Patent: Jul. 11, 2006

(54) SPRING-CHARGED MECHANISM ASSEMBLY EMPLOYING TWO TRUNNION MEMBERS MOVEABLE IN DIFFERENT PLANES AND CIRCUIT INTERRUPTER EMPLOYING THE SAME

(75) Inventors: Thomas K. Fogle, Shaler Township, PA (US); Anthony T. Ricciuti, Bethel Park, PA (US); Walter O. Jenkins, Pittsburgh, PA (US); James J. Benke, Pittsburgh, PA (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 11/133,398

(22) Filed: May 19, 2005

(51) Int. Cl.
*H01H 3/38* (2006.01)

(52) U.S. Cl. ..... 218/154; 218/140

(58) Field of Classification Search ..... 218/154, 218/140, 7, 14, 78, 84, 120; 335/164, 165, 335/189–192; 200/400, 401
See application file for complete search history.

(56) References Cited

U.S. PATENT DOCUMENTS

| | | | | |
|---|---|---|---|---|
| 3,590,192 | A | 6/1971 | Bould et al. | |
| 3,750,059 | A | 7/1973 | Patel et al. | |
| 4,114,003 | A * | 9/1978 | Frink et al. | 218/1 |
| 4,384,179 | A | 5/1983 | Milianowicz | |
| 4,743,876 | A | 5/1988 | Milianowicz et al. | |
| 5,003,138 | A * | 3/1991 | Bolongeat-Mobleu et al. | 218/26 |
| 5,095,293 | A | 3/1992 | Patel et al. | |
| 5,422,450 | A * | 6/1995 | Miyazawa et al. | 218/140 |
| 5,523,536 | A * | 6/1996 | Binder et al. | 218/120 |
| 5,530,216 | A | 6/1996 | Benke et al. | |
| 5,726,367 | A | 3/1998 | Patel et al. | |
| 6,286,377 | B1 | 9/2001 | Benke et al. | |
| 6,770,832 | B1 * | 8/2004 | Marchand et al. | 218/140 |

* cited by examiner

*Primary Examiner*—Elvin G. Enad
*Assistant Examiner*—M. Fishman
(74) *Attorney, Agent, or Firm*—Martin J. Moran

(57) ABSTRACT

A mechanism assembly is for a vacuum circuit interrupter including a vacuum housing including a stationary contact and a moveable contact, and an operating mechanism including a drive rod. The mechanism assembly cooperates with the drive rod to open and close the contacts. The mechanism assembly includes a housing having a pair of first longitudinal openings and a pair of second longitudinal openings, the first longitudinal openings defining a first plane, the second longitudinal openings defining a different second plane. A first trunnion member is pivotally and translationally mounted with respect to the first longitudinal openings. The first trunnion member is coupled to the moveable contact. A second trunnion member is pivotally and translationally mounted with respect to the second longitudinal openings. The drive rod is pivotally connected to the second trunnion member. A pair of compression springs are biased between the first and second trunnion members.

21 Claims, 7 Drawing Sheets

SPRING-CHARGED MECHANISM ASSEMBLY EMPLOYING TWO TRUNNION MEMBERS MOVEABLE IN DIFFERENT PLANES AND CIRCUIT INTERRUPTER EMPLOYING THE SAME

BACKGROUND OF THE INVENTION

1. Field of the Invention

This invention pertains generally to circuit interrupters and, more particularly, to circuit interrupters, such as, for example, medium voltage vacuum circuit breakers, employing one or more poles each of which includes a vacuum interrupter. The invention also pertains to operating mechanism assemblies for vacuum circuit interrupters.

2. Background Information

Circuit interrupters provide protection for electrical systems from electrical fault conditions such as, for example, current overloads, short circuits and abnormal level voltage conditions. Typically, circuit interrupters include a spring powered operating mechanism which opens electrical contacts to interrupt the current through the conductors of an electrical system in response to abnormal conditions, although a wide range of driving mechanisms may be employed.

Circuit interrupters, such as, for example, power circuit breakers for systems operating above about 1,000 volts typically utilize vacuum interrupters as the switching devices. Vacuum switching devices (e.g., circuit interrupters; circuit breakers; switches; reclosers) include separable main contacts disposed within an insulating housing. Generally, one of the contacts is fixed relative to both the housing and to an external electrical conductor which is interconnected with the circuit to be controlled by the circuit interrupter. The other contact is moveable. In the case of a vacuum circuit interrupter, the moveable contact assembly usually comprises a stem of circular cross-section having the contact at one end enclosed within a vacuum chamber and a driving mechanism at the other end which is external to the vacuum chamber. An operating rod assembly comprising a push rod, which is fastened to the end of the stem opposite the moveable contact, and a driving mechanism provide the motive force to move the moveable contact into or out of engagement with the fixed contact.

Vacuum interrupters are typically used, for instance, to reliably interrupt medium voltage alternating current (AC) currents and, also, high voltage AC currents of several thousands of amperes or more. Typically, one vacuum interrupter is provided for each phase of a multi-phase circuit and the vacuum interrupters for the several phases are actuated simultaneously by a common operating mechanism, or separately by separate operating mechanisms (and auxiliary switches).

Known medium voltage vacuum circuit interrupters using spring-charged stored energy mechanisms lack the requisite force to maintain necessary contact pressure to withstand current levels dictated by a withstand test for a 75 kA rating.

Accordingly, there is room for improvement in circuit interrupters. There is also room for improvement in operating mechanism assemblies for vacuum circuit interrupters.

SUMMARY OF THE INVENTION

These needs and others are met by the present invention, which employs a conventional stored energy operating mechanism to drive a separate spring-charged toggle mechanism including two movable trunnions coupled to each other by a contact spring assembly. The trunnions move in separate planes and take advantage of the toggle mechanism to increase the contact force at the end of the toggle mechanism travel when the contacts are closed and, also, to assist in separating the fixed and moveable contacts as the contacts are opened.

In accordance with one aspect of the invention, a circuit interrupter comprises: first and second terminals; a vacuum housing comprising separable contacts including a stationary contact and a moveable contact, the first terminal being electrically connected to the stationary contact and the second terminal being electrically connected to the moveable contact; an operating mechanism comprising a drive rod, the operating mechanism being structured to move the drive rod in a general first direction to close the separable contacts, and to move the drive rod in a general opposite second direction to initiate opening of the separable contacts; and a mechanism assembly cooperating with the drive rod to open and close the separable contacts, the mechanism assembly comprising: a housing including a pair of first longitudinal openings and a pair of second longitudinal openings, the first longitudinal openings defining a first plane, the second longitudinal openings defining a different second plane, a first trunnion member pivotally and movably mounted with respect to the first longitudinal openings of the housing, the first trunnion member being coupled to the moveable contact, a second trunnion member pivotally and movably mounted with respect to the second longitudinal openings of the housing, the drive rod being pivotally connected to the second trunnion member, and at least one spring biased between the first trunnion member and the second trunnion member.

The separable contacts may include a closed position, a contacts touch position and an open position. The mechanism assembly may include a closed position corresponding to the closed position of the separable contacts, a contacts touch position corresponding to the contacts touch position of the separable contacts, a toggle position between the closed and contacts touch positions of the mechanism assembly, and an open position corresponding to the open position of the separable contacts. During opening of the separable contacts, from the toggle position to the open position of the mechanism assembly, the at least one spring may assist the operating mechanism in driving the second trunnion member in the second longitudinal openings.

Between the closed position and the toggle position of the mechanism assembly, the force from the at least one spring may be generally normal to the second longitudinal openings. Between the toggle position and the open position of the mechanism assembly, the force from the at least one spring may be sufficiently close to parallel to the second longitudinal openings, in order that the at least one spring provides additional opening force to open the separable contacts and assist the operating mechanism in the event that the separable contacts are partially welded closed.

After the opening of the separable contacts, the second trunnion member may be structured to move in the second longitudinal openings in a third direction to a maintenance position in which the at least one spring is not compressed and can be safely assembled or disassembled.

The mechanism assembly may include a closed position and an open position. The first trunnion member may be coupled to the moveable contact by a pin member and a clevis connector having a first end and a second end, the first end of the clevis connector being fixedly coupled to the moveable contact, the second end of the clevis connector being pinned to the first trunnion member by the pin member, in order that the first trunnion member pivots about the pin member between the open and closed positions of the mechanism assembly.

The second trunnion member may include a first side and an opposite second side. The first side and the opposite second side may include a trunnion pin carrying a bearing mechanism captured in a corresponding one of the second longitudinal openings.

The first trunnion member may be coupled to the moveable contact by a pin member having a first end and an opposite second end. Each of the first and second ends may carry a bearing mechanism captured in a corresponding one of the first longitudinal openings.

The mechanism assembly may include an opening dimension, which is defined by a distance between the first trunnion member and the second trunnion member. The at least one spring may be at least substantially compressed in the opening dimension between the first trunnion member and the second trunnion member.

The first trunnion member may include a rod member having a first end coupled to the first trunnion member and a second end. The second trunnion member may include a bottom and an opening through which the second end of the rod member passes. A snatch gap may be defined between the bottom of the second trunnion member and a portion of the second end of the rod member, in order to indicate wear of the separable contacts.

As another aspect of the invention, a mechanism assembly is for a vacuum circuit interrupter including first and second terminals, a vacuum housing comprising separable contacts including a stationary contact and a moveable contact, the first terminal being electrically connected to the stationary contact and the second terminal being electrically connected to the moveable contact, an operating mechanism comprising a drive rod, the operating mechanism being structured to move the drive rod in a general first direction to close the separable contacts, and move the drive rod in a general opposite second direction to initiate the opening of the separable contacts. The mechanism assembly cooperates with the drive rod to open and close the separable contacts and comprises: a housing including a pair of first longitudinal openings and a pair of second longitudinal openings, the first longitudinal openings defining a first plane, the second longitudinal openings defining a different second plane; a first trunnion member pivotally and movably mounted with respect to the first longitudinal openings of the housing, the first trunnion member being coupled to the moveable contact; a second trunnion member pivotally and movably mounted with respect to the second longitudinal openings of the housing, the drive rod being pivotally connected to the second trunnion member; and at least one spring biased between the first trunnion member and the second trunnion member.

The first plane of the first longitudinal openings may be about normal to the second plane of the second longitudinal openings.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

The present invention is described in association with a medium voltage vacuum circuit breaker, although the invention is applicable to a wide range of circuit interrupters and operating mechanism assemblies therefor.

Figure 1:
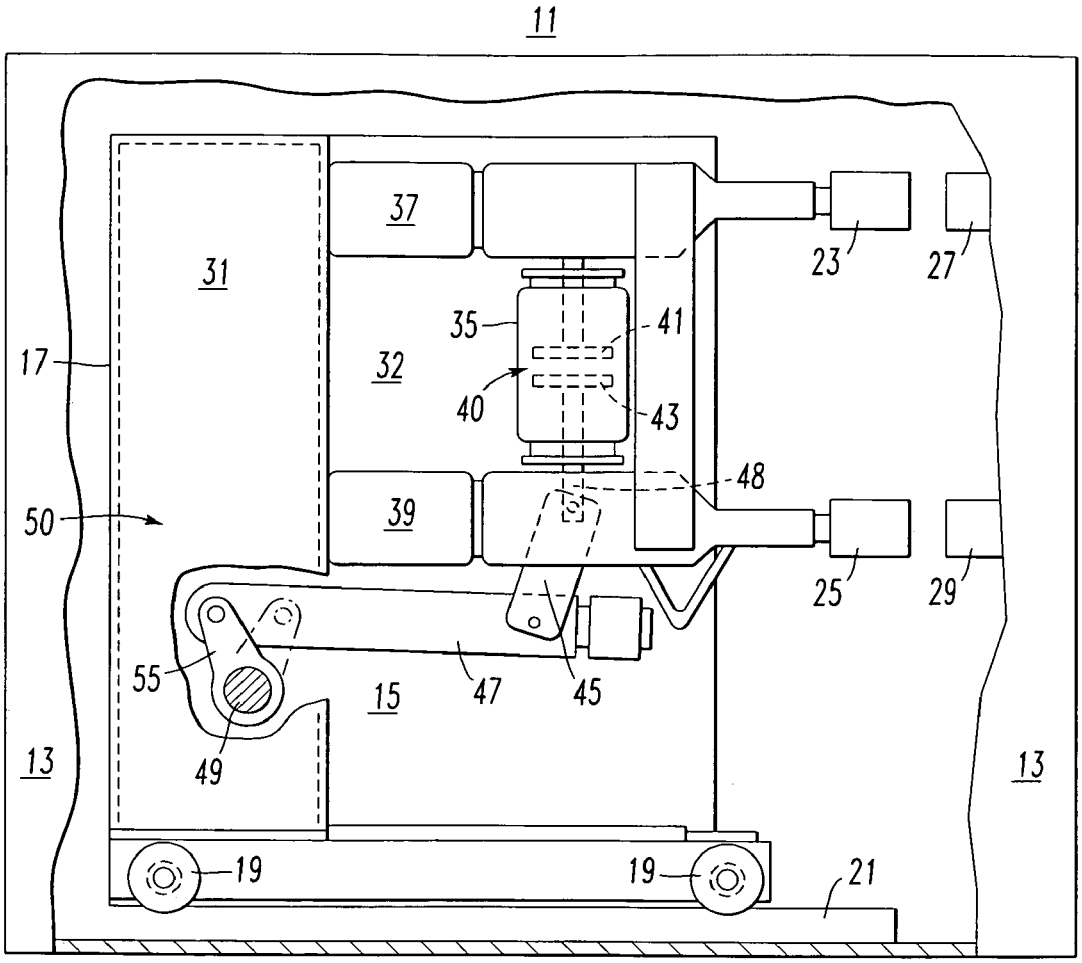
FIG. 1 PRIOR ART
FIG. 1 is a side elevational view of a drawout circuit breaker.

Referring to FIG. 1, a metal-clad or metal-enclosed switchgear apparatus is generally indicated at 11 and includes a metal cabinet or enclosure 13 for enclosing a drawout vacuum circuit breaker 15. The circuit interrupter 15 is preferably a drawout three-phase vacuum circuit interrupter and may have controls on a front panel 17 for manually operating the circuit breaker. The circuit breaker 15 is movably disposed on wheels 19 on rails 21 into and out of the enclosure 13. In that manner, terminals 23,25 on the circuit breaker 15 are moved into and out of electrical contact with corresponding terminals 27,29 within the enclosure 13.

The circuit breaker 15 preferably embodies a three-phase interrupter apparatus having a front low voltage portion 31 adjacent to the front panel 17 and a rear high voltage portion 32 including a vacuum circuit interrupter 35 for each phase (only one phase is shown in FIG. 1). Upper and lower insulators 37,39 electrically insulate the high and low voltage portions 32,31 from each other. Within each vacuum interrupter 35, a pair of separable contacts 40 including a stationary contact 41 and movable contact 43 is provided. The separable contacts 40 are operated between open (FIG. 1) and closed (not shown) electrical circuit conditions by a linkage 45. This linkage 45 includes an insulating link 47 which extends between the low voltage portion 31 and a movable contact stem 48 that moves the moveable contact 43. Details regarding the operating mechanism 50 for moving the contacts 41,43 between the open circuit position and the closed circuit position are described in U.S. Pat. No. 4,743,876, which is incorporated by reference herein. Example manual and electric motor charging mechanisms for the operating mechanism 50 are disclosed in U.S. Pat. Nos. 3,590,192 and 3,750,059, which are incorporated by reference herein.

The operating mechanism 50 is contained in the front low voltage portion 31 and operates a number of driven parts one of which is a pole or operating shaft 49 that is rotatably mounted in opposite sidewalls (not shown) of a frame or housing. The shaft 49, when rotated, opens and closes the contacts 41,43 in the phases of the switchgear apparatus 11. For that purpose, the insulating link 47 is connected by a pair of arms 55 (only one arm 55 is shown), which are fixedly mounted on the shaft 49.

Figure 2:
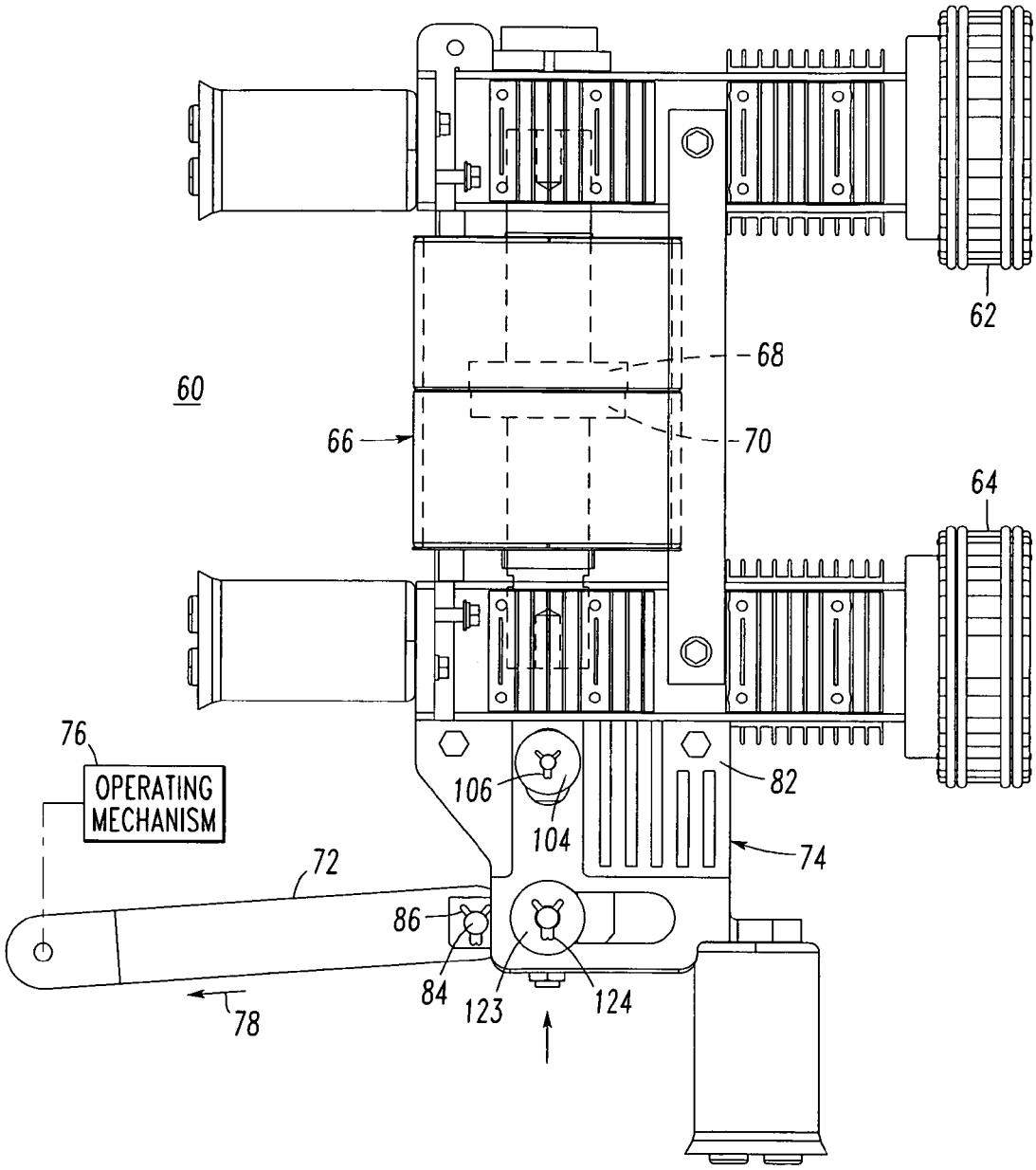
FIG. 2 is a vertical elevational view of a circuit interrupter including conductive terminals, a vacuum housing having a stationary contact and a moveable contact shown in a closed position, an end mechanism assembly and a drive rod in accordance with the present invention.

FIG. 2 shows a circuit interrupter 60 in accordance with the present invention. The circuit interrupter 60 includes conductive terminals 62,64, a vacuum housing 66 having a stationary contact 68 (shown in hidden line drawing) and a moveable contact 70 (shown in hidden line drawing) shown in a closed position, a drive rod 72 and an end mechanism assembly 74 in accordance with the invention. As is conventional, the conductive terminal 62 is electrically connected to the stationary contact 68 and the conductive terminal 64 is electrically connected to the moveable contact 70.

As important aspects of the invention, an operating mechanism 76 moves the drive rod 72 generally left (with respect to FIG. 2), as shown by arrow 78, to close the separable contacts 68,70 through the end mechanism assembly 74, and moves the drive rod 72 generally right (with respect to FIG. 3), as shown by arrow 80, to initiate the opening of the separable contacts 68,70 through the end mechanism assembly 74.

Figure 3:
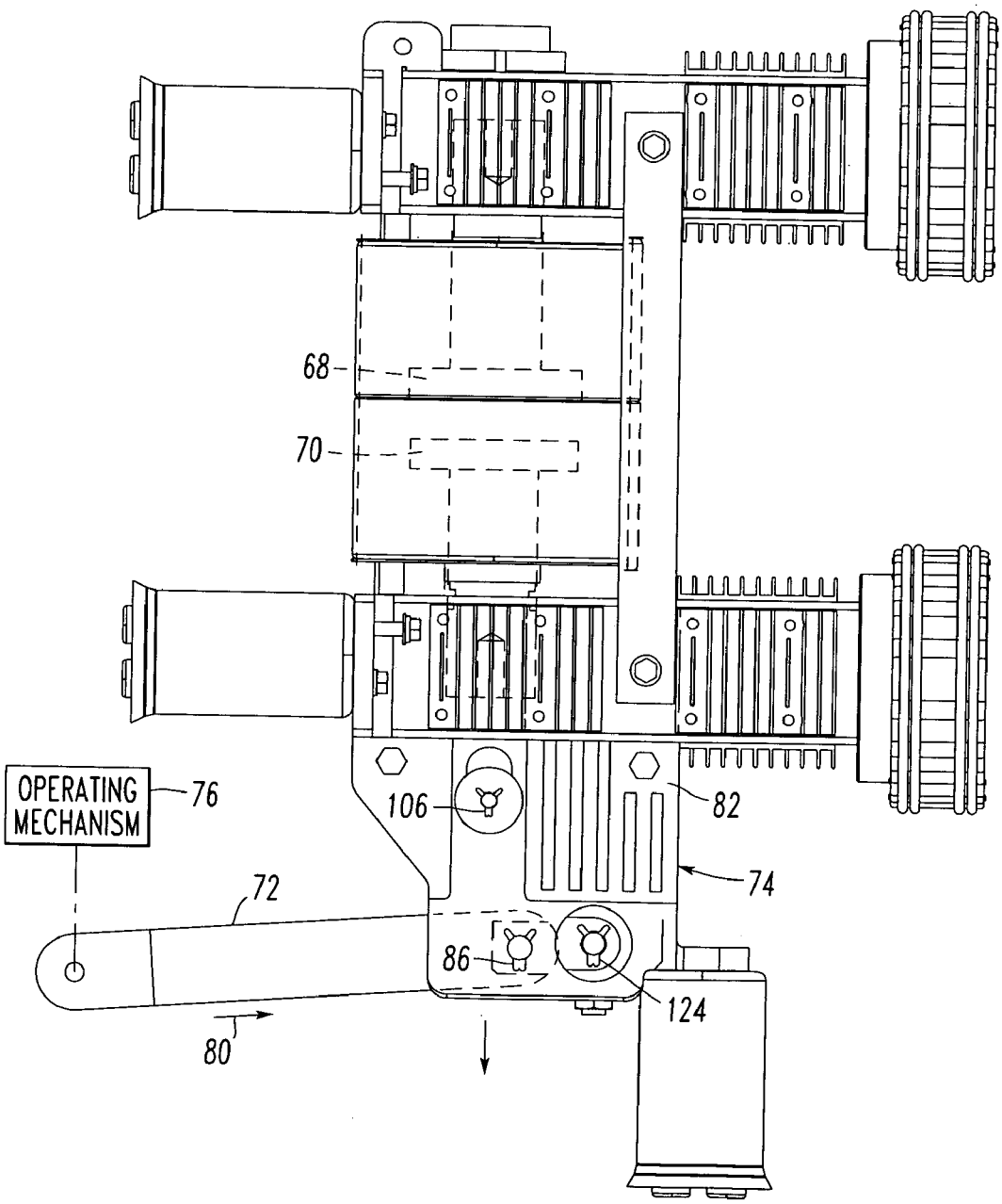
FIG. 3 is a vertical elevational view of the circuit interrupter of FIG. 2, but with the stationary and moveable contacts in the open position.
Figure 4:
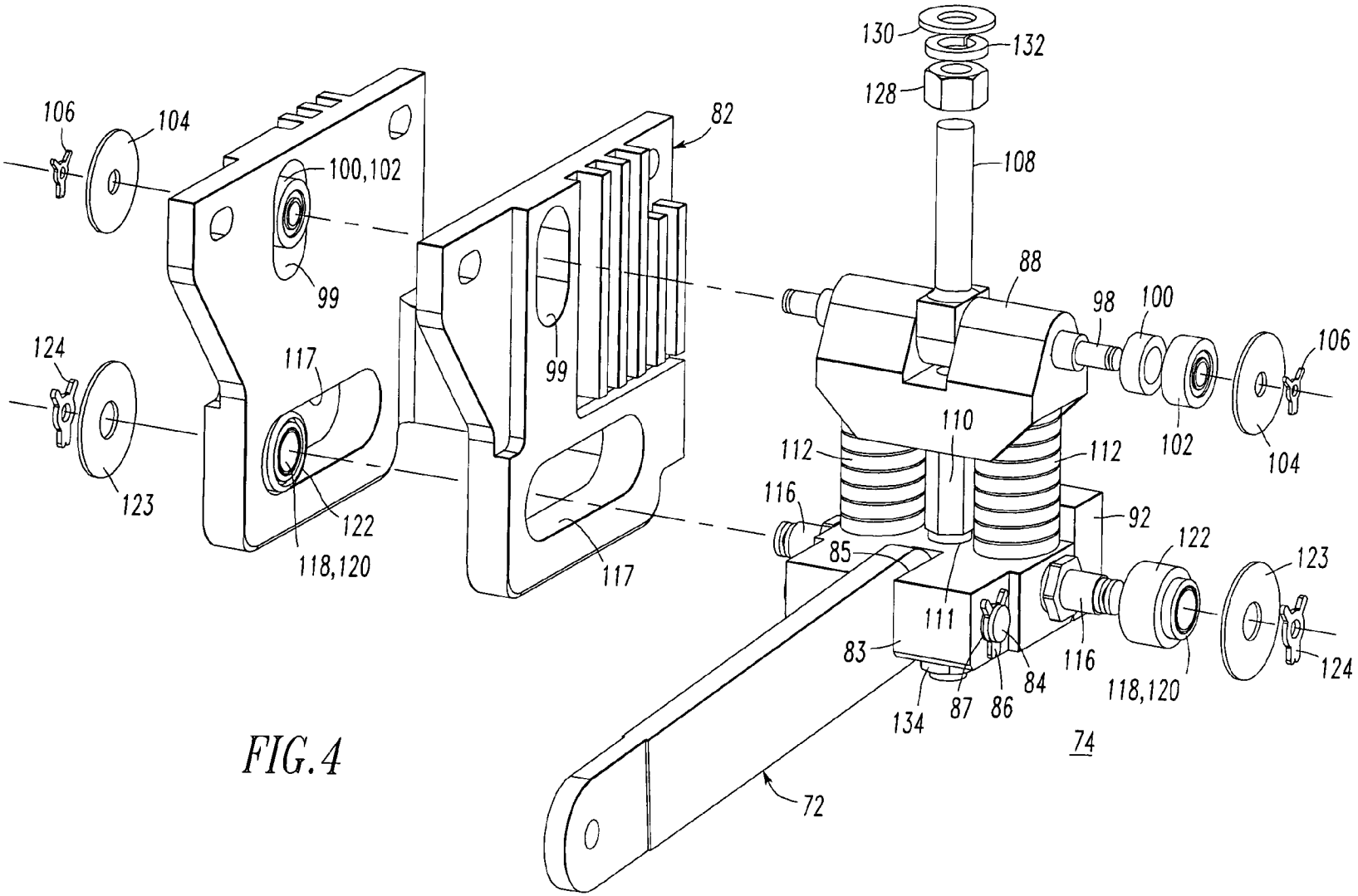
FIG. 4 is a partially exploded isometric view of the end mechanism assembly of FIG. 2.
Figure 6:
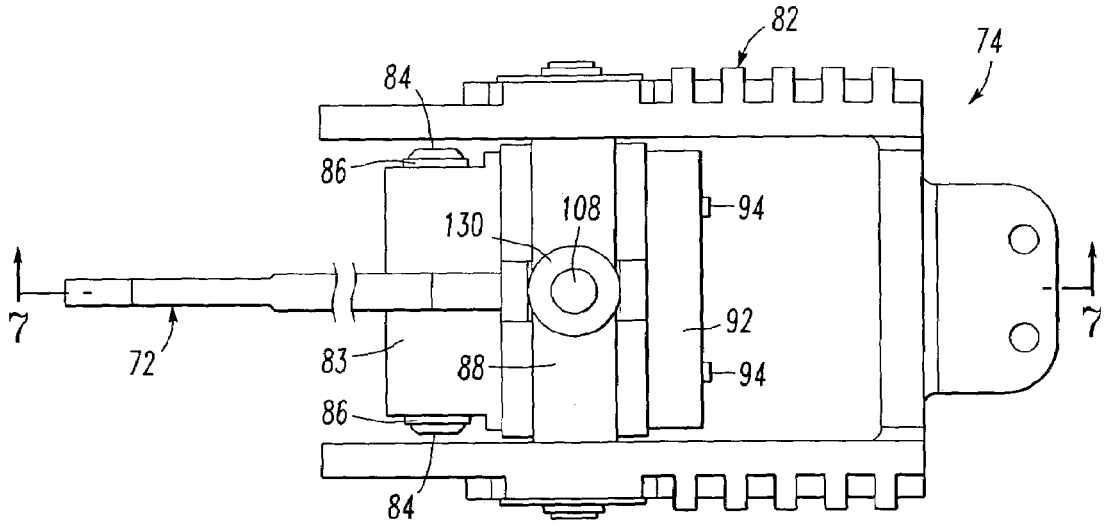
FIG. 6 is a top plan view of the end mechanism assembly of FIG. 2 in the closed position.

Referring to FIGS. 2–4, the end mechanism assembly 74 cooperates with the drive rod 72 and includes an end mechanism housing 82. The drive rod 72 is pivotally connected to a lower (with respect to FIGS. 2–4) mechanism trunnion block 83 of the end mechanism assembly 74 by a drive rod pin 84. The end of the drive rod 72 pivots within a slot 85 of the block 83. The drive rod pin 84 is held in place at each end thereof by an X-washer 86 (both of which are shown in FIG. 6) and a lock washer 87 (only one is shown in FIGS. 2–4) as shown on one of those ends (to the right side of FIG. 4). The end mechanism assembly 74 also includes an upper (with respect to FIGS. 2–4) spring trunnion block 88 and a spring trunnion mass 92, which is attached to the mechanism trunnion block 83 by suitable fasteners 94 (as shown in FIG. 6) (e.g., without limitation, screws and lock washers).

The spring trunnion block 88 is pivotally and movably mounted with respect to the end mechanism housing 82 by an end mechanism pin 98, which passes through longitudinal vertical (with respect to FIG. 4) openings 99 of the housing 82. Each of the ends of the pin 98 carries a suitable bearing mechanism, such as an end mechanism bearing spacer 100 and an end mechanism bearing 102, which are disposed within the corresponding one of the housing openings 99 for translation therein as shown in FIGS. 7–10. The spacer 100, bearing 102 and the corresponding end of the pin 98 are held captured within the opening 99 by a washer (e.g., brass) 104 and an X-washer 106 at each end.

Figure 7:
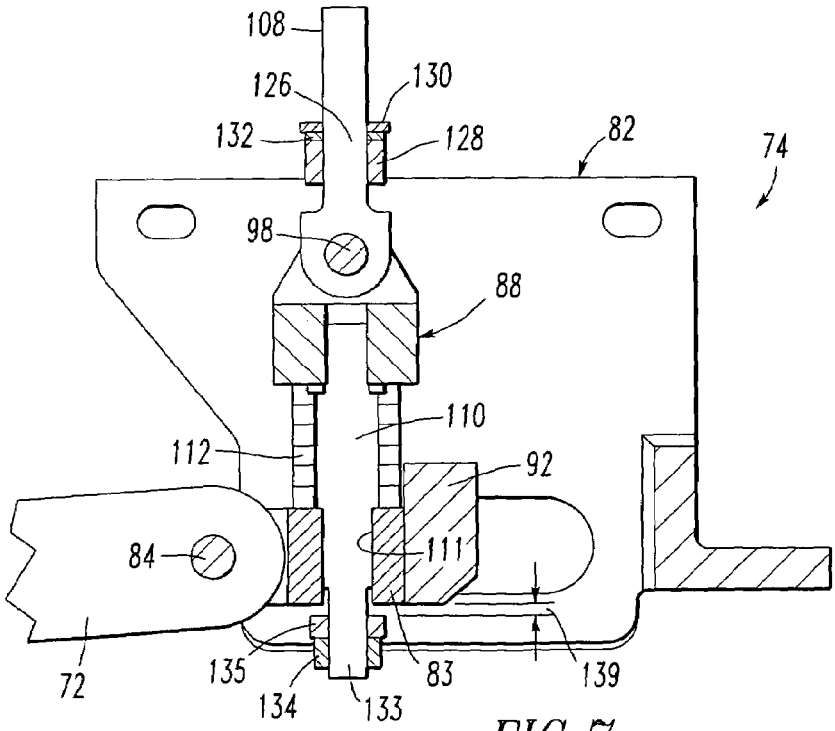
FIG. 7 is a cross-sectional view along lines 7—7 of FIG. 6.
Figure 8:
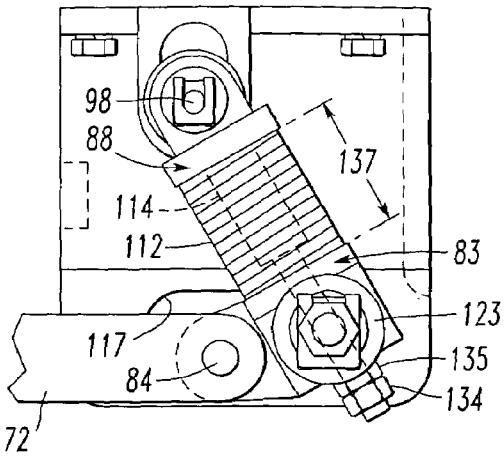
FIG. 8 is a side elevational view of the end mechanism assembly of FIG. 2 in the open position.
Figure 9:
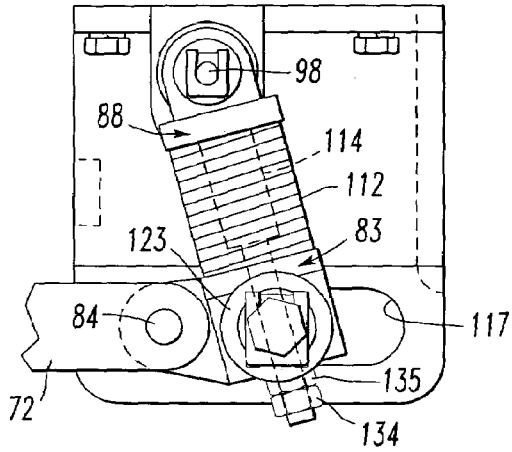
FIG. 9 is a side elevational view of the end mechanism assembly of FIG. 2 in the contacts touch position.
Figure 10:
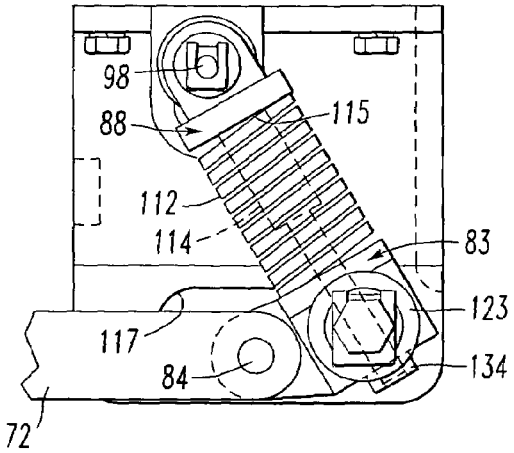
FIG. 10 is a side elevational view of the end mechanism assembly of FIG. 2 in a maintenance position.

A clevis connector 108 is pinned to the spring trunnion block 88 by the pin 98, such that the spring trunnion block 88 may pivot counterclockwise (with respect to FIGS. 4 and 8–10) about the pin 98 from the position shown in FIG. 4. A trunnion rod 110 is threaded at its upper (with respect to FIGS. 4 and 7–10) end to the spring trunnion block 88 and its lower (with respect to FIGS. 4 and 7–10) end freely passes through an opening 111 (FIG. 7) in the mechanism trunnion block 83. A pair of end mechanism compression springs 112 are disposed between the spring trunnion block 88 and the mechanism trunnion block 83. Although two example springs 112 are shown, one or more suitable springs may be employed. The springs 112 are held in position by end mechanism spring guides 114 (only one is shown in FIGS. 8–10), which are threaded at their upper (with respect to FIGS. 4 and 7–10) end to the spring trunnion block 88. As shown in FIG. 10, a lock washer 115 is disposed at the top of the spring guide 114 between its upper (with respect to FIG. 10) end and the spring trunnion block 88.

Two trunnion pins 116 are threaded in corresponding opposite sides of the mechanism trunnion block 83. This trunnion block 83 is pivotally and movably mounted with respect to the end mechanism housing 82 by the trunnion pins 116, which pass through horizontal (with respect to FIG. 4) longitudinal openings 117 of the housing 82. Each of the ends of the pins 116 carries a suitable bearing mechanism, such as an end mechanism inner ring 118, an end mechanism needle bearing 120 and a roller bearing 122, which are disposed within the corresponding one of the housing openings 117 for translation therein as shown in FIGS. 7–10. The end mechanism inner ring 118, the end mechanism needle bearing 120, the roller bearing 122 and the end of the pin 116 are held captured within the corresponding opening 117 by a washer (e.g., brass) 123 and an X-washer 124 at each end.

Figure 5:
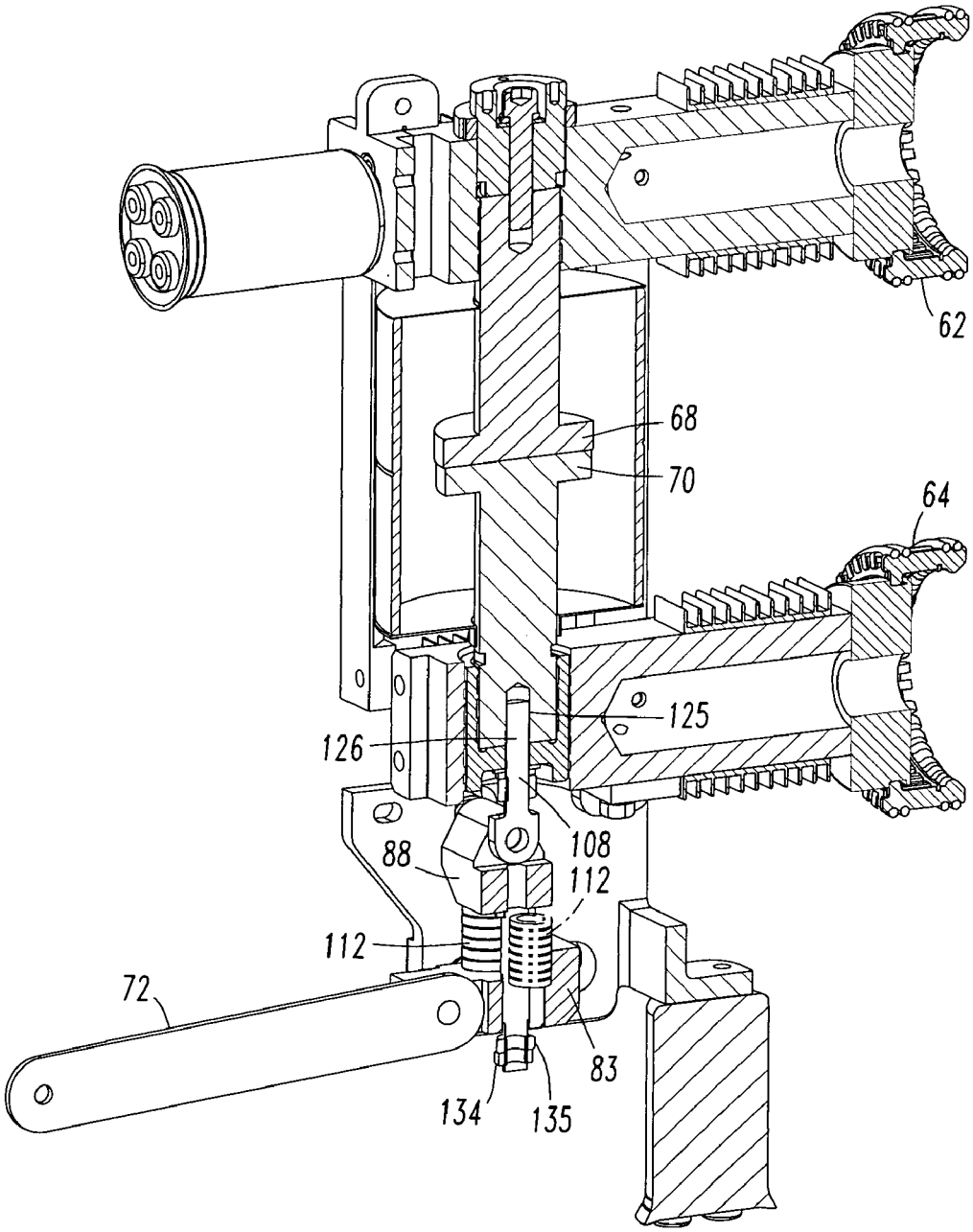
FIG. 5 is a cross-sectional isometric view of the circuit interrupter of FIG. 2.

As best shown in FIG. 5, the upper end (with respect to FIG. 5) of the clevis connector 108 has a threaded shaft 126 that is secured in a threaded opening 125 of the moveable contact 70. As best shown in FIG. 7, on the threaded shaft 126 are disposed a hex nut 128, a washer 130 and a lock washer 132, which further secure the upper end of the clevis connector 108 to the moveable contact 70 (FIG. 5). The lower end (with respect to FIG. 7) of the trunnion rod 110 is a threaded shaft 133 on which are secured a lock nut 134 and a lock washer 135.

The end mechanism assembly 74 of FIG. 7 is preferably calibrated as shown in FIG. 8 to provide a suitable opening setting 137 of the springs 112, which setting is measured between the spring trunnion block 88 and the mechanism trunnion block 83, as shown by the partially compressed length of the springs 112. The operating mechanism 76 (FIG. 2) drives the drive rod 72, which compresses the springs 112 and drives the spring trunnion block 88, the clevis connector 108 and the moveable contact 70 upward (with respect to FIG. 5) to close the separable contacts 68,70. A suitable snatch gap 139 is also preferably calibrated between the bottom (with respect to FIG. 7) of the mechanism trunnion block 83 and the lock washer 135 to provide an indication of wear of the separable contacts 68,70. For example, the gap 139 becomes progressively smaller with wear of the contacts 68,70.

FIGS. 6 and 7 show a top plan view and a cross-sectional view, respectively, of the end mechanism assembly 74 of FIG. 2 in the closed position. In contrast, FIG. 8 shows the end mechanism assembly 74 in the open position. As the drive rod 72 is driven to the left (with respect to FIGS. 8 and 9) by the operating mechanism 76 (FIG. 2), the springs 112 are compressed and the moveable contact 70 is driven upward (with respect to FIG. 5) by the spring trunnion block 88 and the clevis connector 108 until the contacts 68,70 first touch in the position of FIG. 9. Then, as the drive rod 72 is further driven to the left (with respect to FIGS. 9 and 7) by the operating mechanism 76 (FIG. 2), the springs 112 are fully compressed and the moveable contact 70 is driven fully upward (with respect to FIG. 5) to the closed position of FIGS. 5 and 7.

During opening of the contacts 68,70, the process is essentially reversed from FIGS. 5 and 7, to FIG. 9 and to FIG. 8, with one exception. There is a "toggle" position of the end mechanism assembly 74, which occurs between the "closed" position of FIGS. 5 and 7 and the "contacts touch" position of FIG. 9. At this point, the end mechanism springs 112 advantageously begin assisting the opening of the contacts 68,70. During closure, however, the springs 112 are compressed and are fully locked just prior to the toggle position. During opening, from the "toggle" position of the end mechanism assembly 74 to the "contacts touch" position of FIG. 9 to the "open" position of FIG. 8, both the operating mechanism 76 (through the drive rod 72) and the springs 112 drive the mechanism trunnion block 83 to the right (with respect to FIGS. 7–9) in the longitudinal openings 117. However, between the "closed" position and the "toggle" position of the end mechanism assembly 74, the vector of the force from the compressed springs 112 is sufficiently normal to the longitudinal openings 117, such that friction between the roller bearings 122 and the corresponding openings 117 resists an opening force from the springs 112. At the "toggle" position of the end mechanism assembly 74, the vector of the force from the compressed springs 112 is sufficiently close to parallel to the longitudinal openings 117, such that the springs 112 provide additional opening force to open the contacts 68,70. This advantageously assists the operating mechanism 76 in the event that the contacts 68,70 might be partially welded closed.

FIG. 10 is a side elevational view of the end mechanism assembly 74 of FIG. 2 in a maintenance position. In this maintenance position, the end mechanism springs 112 are not compressed and, hence, can be safely assembled or disassembled upon removal of the spring trunnion mass 92.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof

What is claimed is:

1. A circuit interrupter comprising:

first and second terminals;

a vacuum housing comprising separable contacts including a stationary contact and a moveable contact, said first terminal being electrically connected to the stationary contact and said second terminal being electrically connected to the moveable contact;

an operating mechanism comprising a drive rod, said operating mechanism being structured to move the drive rod in a general first direction to close the separable contacts, and to move the drive rod in a general opposite second direction to initiate opening of the separable contacts; and a mechanism assembly cooperating with the drive rod to open and close the separable contacts, said mechanism assembly comprising:

a housing including a pair of first longitudinal openings and a pair of second longitudinal openings, said first longitudinal openings defining a first plane, said second longitudinal openings defining a different second plane, a first trunnion member pivotally and movably mounted with respect to the first longitudinal openings of said housing, said first trunnion member being coupled to said moveable contact, a second trunnion member pivotally and movably mounted with respect to the second longitudinal openings of said housing, said drive rod being pivotally connected to said second trunnion member, and at least one spring biased between said first trunnion member and said second trunnion member.

2. The circuit interrupter of claim 1 wherein said separable contacts include a closed position, a contacts touch position and an open position; wherein said mechanism assembly includes a closed position corresponding to the closed position of said separable contacts, a contacts touch position corresponding to the contacts touch position of said separable contacts, a toggle position between the closed and contacts touch positions of said mechanism assembly, and an open position corresponding to the open position of said separable contacts; and wherein during opening of said separable contacts, from the toggle position to the open position of said mechanism assembly, said at least one spring assists said operating mechanism in driving said second trunnion member in the second longitudinal openings.

3. The circuit interrupter of claim 2 wherein between the closed position and the toggle position of said mechanism assembly, the force from said at least one spring is generally normal to said second longitudinal openings.

4. The circuit interrupter of claim 3 wherein between the toggle position and the open position of said mechanism assembly, the force from said at least one spring is sufficiently close to parallel to said second longitudinal openings, in order that said at least one spring provides additional opening force to open said separable contacts and assist said operating mechanism in the event that said separable contacts are partially welded closed.

5. The circuit interrupter of claim 1 wherein said separable contacts include a closed position and an open position; wherein said mechanism assembly includes a closed position corresponding to the closed position of said separable contacts and an open position corresponding to the open position of said separable contacts; and wherein during closing of said separable contacts, said drive rod drives said second trunnion member in the second longitudinal openings in a first direction, which compresses said at least one spring and drives said first trunnion member in the first longitudinal openings in a second direction, which is generally normal to said first direction, in order to move said moveable contact and close said separable contacts.

6. The circuit interrupter of claim 5 wherein during opening of said separable contacts, said drive rod drives said second trunnion member in the second longitudinal openings in a third direction, which is opposite said first direction; and wherein said first trunnion member moves in the first longitudinal openings in a fourth direction, which is opposite said second direction, in order to move said moveable contact and open said separable contacts.

7. The circuit interrupter of claim 6 wherein after said opening of said separable contacts, said second trunnion member is structured to move in the second longitudinal openings in the third direction to a maintenance position in which said at least one spring is not compressed and can be safely assembled or disassembled.

8. The circuit interrupter of claim 1 wherein said mechanism assembly includes a closed position and an open position; wherein said first trunnion member is coupled to said moveable contact by a pin member and a clevis connector having a first end and a second end, the first end of said clevis connector being fixedly coupled to said moveable contact, the second end of said clevis connector being pinned to said first trunnion member by said pin member, in order that said first trunnion member pivots about said pin member between said open and closed positions of said mechanism assembly.

9. The circuit interrupter of claim 8 wherein the first end of said clevis connector has a threaded shaft; and wherein said moveable contact includes a stem having an opening, said threaded shaft being coupled to said stem at the opening thereof.

10. The circuit interrupter of claim 1 wherein said at least one spring includes two compression springs having central openings, said springs being compressed between said first trunnion member and said second trunnion member; and wherein said first trunnion member includes two spring guides disposed through the central openings of said two compression springs.

11. The circuit interrupter of claim 1 wherein said second trunnion member includes a first side and an opposite second side; and wherein each of said first side and said opposite second side includes a trunnion pin carrying a bearing mechanism captured in a corresponding one of said second longitudinal openings.

12. The circuit interrupter of claim 11 wherein said bearing mechanism includes an inner ring, a needle bearing and a roller bearing.

13. The circuit interrupter of claim 1 wherein said separable contacts include a closed position, a contacts touch position and an open position; wherein said mechanism assembly includes a closed position corresponding to the closed position of said separable contacts, a contacts touch position corresponding to the contacts touch position of said separable contacts, and an open position corresponding to the open position of said separable contacts; and wherein during closing of said separable contacts, said drive rod drives said second trunnion member in the second longitudinal openings, which compresses said at least one spring and drives said first trunnion member in the first longitudinal openings to the contacts touch position of said mechanism assembly, in order to move said separable contacts to said contacts touch position thereof.

14. The circuit interrupter of claim 13 wherein as said drive rod further drives said second trunnion member in the second longitudinal openings, said second trunnion member fully compresses said at least one spring and drives said first trunnion member in the first longitudinal openings to the closed position of said mechanism assembly, in order to move said separable contacts to said closed position thereof.

15. The circuit interrupter of claim 1 wherein said first trunnion member is coupled to said moveable contact by a pin member having a first end and an opposite second end; and wherein each of the first and second ends carries a bearing mechanism captured in a corresponding one of said first longitudinal openings.

16. The circuit interrupter of claim 15 wherein said bearing mechanism includes a spacer and a bearing.

17. The circuit interrupter of claim 1 wherein said mechanism assembly includes an opening dimension, which is defined by a distance between said first trunnion member and said second trunnion member; and wherein said at least one spring is at least substantially compressed in said opening dimension between said first trunnion member and said second trunnion member.

18. The circuit interrupter of claim 1 wherein said first trunnion member includes a rod member having a first end coupled to said first trunnion member and a second end; wherein said second trunnion member includes a bottom and an opening through which the second end of said rod member passes; and wherein a snatch gap is defined between the bottom of said second trunnion member and a portion of the second end of said rod member, in order to indicate wear of said separable contacts.

19. A mechanism assembly for a vacuum circuit interrupter including first and second terminals, a vacuum housing comprising separable contacts including a stationary contact and a moveable contact, said first terminal being electrically connected to the stationary contact and said second terminal being electrically connected to the moveable contact, an operating mechanism comprising a drive rod, said operating mechanism being structured to move the drive rod in a general first direction to close the separable contacts, and move the drive rod in a general opposite second direction to initiate the opening of the separable contacts, said mechanism assembly cooperating with the drive rod to open and close the separable contacts, said mechanism assembly comprising:

a housing including a pair of first longitudinal openings and a pair of second longitudinal openings, said first longitudinal openings defining a first plane, said second longitudinal openings defining a different second plane;

a first trunnion member pivotally and movably mounted with respect to the first longitudinal openings of said housing, said first trunnion member being coupled to said moveable contact;

a second trunnion member pivotally and movably mounted with respect to the second longitudinal openings of said housing, said drive rod being pivotally connected to said second trunnion member; and at least one spring biased between said first trunnion member and said second trunnion member.

20. The mechanism assembly of claim 19 wherein said separable contacts include a closed position, a contacts touch position and an open position; wherein said mechanism assembly includes a closed position corresponding to the closed position of said separable contacts, a contacts touch position corresponding to the contacts touch position of said separable contacts, a toggle position between the closed and contacts touch positions of said mechanism assembly, and an open position corresponding to the open position of said separable contacts; and wherein from the toggle position to the open position of said mechanism assembly, said at least one spring is structured to assist said operating mechanism to drive said second trunnion member in the second longitudinal openings during opening of said separable contacts.

21. The mechanism assembly of claim 19 wherein the first plane of said first longitudinal openings is about normal to the second plane of said second longitudinal openings.

* * * * *